United States Patent [19]

Seago

[11] Patent Number: 5,056,441

[45] Date of Patent: Oct. 15, 1991

[54] FITTED MATTRESS COVER AND METHOD OF MAKING SAME

[75] Inventor: Michael E. Seago, Louisville, Ky.

[73] Assignee: Louisville Bedding Co., Louisville, Ky.

[21] Appl. No.: 600,812

[22] Filed: Oct. 22, 1990

Related U.S. Application Data

[62] Division of Ser. No. 482,515, Feb. 21, 1990, Pat. No. 4,985,953.

[51] Int. Cl.[5] ..... D05B 11/00; A47G 9/00

[52] U.S. Cl. ..... 112/2.1; 112/121.26; 112/163; 112/262.1; 5/497

[58] Field of Search ..... 112/2.1, 2.2, 117, 121.26, 112/254, 262.1, 121.27, 163; 5/482, 486, 496, 497, 499, 500

[56] References Cited

U.S. PATENT DOCUMENTS

| | | | |
|---|---|---|---|
| 2,162,755 | 6/1939 | Shauer | 5/497 |
| 2,856,615 | 10/1958 | Cirocco | 5/500 |
| 3,020,566 | 2/1962 | Anderson et al. | 5/497 |
| 3,150,621 | 9/1964 | Warnock | 112/121.27 |
| 4,370,937 | 2/1983 | Fontcuberta | 112/121.26 X |
| 4,682,555 | 7/1987 | Bierbaum et al. | 112/121.26 X |
| 4,703,530 | 11/1987 | Gusman | 5/499 X |
| 4,727,608 | 3/1988 | Joyce | 112/262.1 X |

*Primary Examiner*—Werner H. Schroeder
*Assistant Examiner*—Paul C. Lewis
*Attorney, Agent, or Firm*—Jon C. Winger

[57] ABSTRACT

A fitted mattress cover for enveloping the top surface side and end surfaces of a mattress constructed to drastically minimize the shifting of the cover relative to the mattress. The fitted mattress cover includes a top panel for fitting in overlaying relationship to the top surface of the mattress and a peripheral skirt depending from the peripheral edge of the top panel for fitting in overlaying relationship to the sides and ends of the mattress. The depending skirt includes a layer of fabric material and a plurality of parallel, spaced-apart elastic cords stitched into the skirt fabric to gather the fabric material into folds perpendicular to the longitudinal axis of the elastic cords. Also, a method of making the fitted mattress cover includes forming a top panel of fabric material for the top panel, forming a flat layer of fabric material for the skirt, longitudinally straining a plurality of parallel spaced apart elastic cords, concurrently stitching the cords into the flat layer of skirt fabric material, allowing the elastic cords to relax forming gathers in the layer of skirt material with the axis of the folds of the gathers perpendicular to the longitudinal axis of the elastic cords.

10 Claims, 10 Drawing Sheets

FITTED MATTRESS COVER AND METHOD OF MAKING SAME

This is a division of application Ser. No. 07/482,515, filed Feb. 21, 1990 now U.S. Pat. No. 4,985,953.

BACKGROUND OF THE INVENTION

The present invention relates to mattress covers and more particularly to fitted mattress covers having a fabric material top panel to overlay the top surface of the mattress, and side and end panels depending from the top panel for fitting around the sides and ends of the mattress.

Fitted mattress coverings are, per se, known.

As used herein, the term mattress cover is used in its generic sense to mean sheets, and covers used underneath to protect the mattress, and bed spreads used over sheets to provide a neat or decorative appearance to a bed. Also, as used herein, the term elastic cord is used in its generic sense to mean, for example, all strips or yarns of an elastic material.

One well-known type of fitted sheet includes a top fabric panel of relatively inextendible or non-stretchable fabric to overlay the top surface of a mattress, and depending side and end panels also of a relatively inextendible or non-stretchable fabric to overlay the sides and ends, respectively, of the mattress. The adjacent ends of the depending end and side panels are sewn together so that the juncture of the adjoined side and end panels, and the top panel forms four corners for receiving the four corners of the mattress, and an elastic band is sewn to the bottom edges of the side and bottom panels defining a bottom opening. When the sheet is installed on a mattress, the elastic band pulls the bottom peripheral edge of the side and end panels over the peripheral bottom edge of the mattress to hold the sheet in place and to take up or pull any excess material of the depth of the side and end panels of the sheet beneath the mattress. In addition, because all mattresses are not of the same peripheral dimension or, for that matter, thickness dimension, a mattress cover of this known type with side panels of a specified width will only properly tightly fit a limited size range of mattresses. When installed on a mattress which is too small either in the peripheral dimension or in the thickness dimension, or both dimensions, this heretofore-known sheet will not fit tightly resulting in a loose fit which allows the cover to slip relative to the mattress. Also, when this heretofore-known sheet is installed on a mattress, which is too small for it to fit tightly, creases can be formed in the loose top fabric panel which can be an irritation and uncomfortable to a person laying on the mattress.

One such proposed solution offered by Perfect Fit Industries marketed under their trademarks "FLEX-WALL" and "BEDSACK" is to provide the depending side panels and end panels of a mattress covering so that these side panels and end panels will resiliently extend or stretch in a direction perpendicular to the length of the side panels and end panels, that is, in the direction of the thickness of the mattress when installed thereon. This feature may solve the problem of adapting a mattress cover to fit mattresses of different thickness dimensions, but it does not solve the problem of adapting a mattress cover to fit mattresses of different peripheral dimensions. In addition, the construction of this mattress cover is relatively expensive. The side panels and end panels are formed of three overlaying fabric sheets.

One of the outside fabric layers is the outside or exposed surface of the side and end panels, and the other one of the outside fabric layers is the inside surface of the side and end panels. The fabric material of these outside layers is substantially non-extendible, and the fabric of the intermediate layer is an elastic or stretchable. The non-extendible outer fabric layers are overlayed on the intermediate membrane layer when it is in a stretched condition in one direction, and the outer layer are sewn to the intermediate membrane layer by widely spaced-apart stitch lines of inelastic threads. When the intermediate membrane layer is relaxed, large folds are formed in the outer fabric layers. The side and end panels are attached to the top panel with the inelastic threads perpendicular to the longitudinal direction or length dimension of the side and end panels such that when the cover is installed on a mattress, the longitudinal axis of the large folds are parallel to the longitudinal direction of the side and end walls of the mattress.

Various other proposed solutions are shown in the following U.S. Patents.

U.S. Pat. No. 2,528,313 issued on Oct. 31, 1950 to William L. Kessler discloses a mattress cover, and more particularly a sheet, of a single piece of knitted resilient fabric having greater stretch in one direction. The fitted mattress cover has a top panel and depending side and end panels stitched together at their junctures to form four corners each for receiving a different one of the corners of the mattress. The top panel has the greatest stretch in the transverse direction or crosswise of the mattress, the side panels have their greatest stretch perpendicular to their length dimension or in the direction of the thickness of the mattress, and the end panels have their greatest stretch in their length dimension or in the direction of the width of the mattress.

U.S. Pat. No. 2,569,627 issued on Oct. 2, 1951 to Morris Black discloses a one-piece self-stretching fitted bed sheet having a rectangular top panel and depending side and end panels stitched together at their junctures to form four corners each for receiving a different one of the corners of the mattress. The bottom edges of the side and end panels are folded over and sewn to form folds, and a peripheral elastic type is located in the folds.

U.S. Pat. No. 2,624,893 issued on Jan. 13, 1953 to Stanley Harris discloses a one-piece fitted bed sheet having a rectangular top panel and depending side and end panels. An elastic corner gore gusset is located between the adjacent end of the side and end panels and sewn thereto to form four corners each for receiving a different one of the corners of the mattress. The elastic gores or gusset have their direction of stretch in the direction of the thickness of the mattress.

U.S. Pat. No. 2,639,444 issued on May 26, 1953 to Estelle S. deMonsabert discloses a fitted mattress cover having rectangular top and bottom panels of a plastic, water repellant material. Side panels and end panels are stitched to the top and bottom panels forming a rectangular enclosure. One of the end panels is formed with a slot through which the mattress is received in the enclosure of the mattress cover. The side and end panels are fabricated of rough-textured, elasticized cotton webbing with a two-way stretch to draw the top and bottom panels into contact with the adjacent top and bottom surfaces of the mattress.

U.S. Pat. No. 2,942,280 issued on June 28, 1960 to Winston L. May discloses a fitted bed sheet having a rectangular top panel and depending side and end panels stitched to the top panel and stitched together at their juncture to form four corners each for receiving a different one of the corners of the mattress. The top panel is fabricated of an inextensible or non-stretchable material such as percale or muslin. The side and end panels are fabricated of a knitted resilient fabric material which is primarily extensible or stretchable in the direction of the depth or thickness of the mattress. In addition, an elastic member is attached to the bottom edges of the side and bottom panels.

U.S. Pat. No. 3,273,175 issued on Sept. 20, 1966 to Martin Anderson discloses a fitted sheet formed of one piece of non-stretchable fabric having a rectangular top panel and depending side and end panels stitched together at their junctures to form four corners each for receiving a different one of the corners of the mattress. Tensioned elastic strips are attached to the corners only of the sheet at the bottom edges of the side and end panels adjacent the corners.

U.S. Pat. No. 3,290,702 issued on Dec. 13, 1966 to Norman Seltzer discloses a fitted sheet fabricated of a single piece of elastic fabric having a top panel and depending side and end panels stitched together at their junctures to form four corners each for receiving a different one of the corners of the mattress. The stretchable or elastic fabric is stretchable or recoverable in one direction and is stabilized in the other direction. This fabric consists of interwoven sets of warp and filling yarns stretchable only either in the direction of the warp, or alternatively in the direction of the filling yarns. The sheet is constructed so that the stretch of the fabric is in the width-wise direction of the mattress and, therefore, the side panels are stretchable in the direction of the thickness of the mattress and the end panels are stretchable in the direction of the width of the mattress.

U.S. Pat. No. 3,789,441 issued on Feb. 5, 1974 to Sidney M. Weiss discloses a fitted sheet fabricated of a single piece of a balanced and stabilized two-way stretch knitted fabric, such as jersey, having a top panel and depending side and end panels stitched together at their junctures to form four corners each for receiving a different one of the corners of a mattress.

SUMMARY OF THE INVENTION

The present invention provides a fitted mattress covering having a top panel for overlaying the top surface of a mattress and depending side and end panels for overlaying the sides and ends, respectively, of the mattress wherein the side panels are comprised of a gathered layer of substantially inelastic material and a plurality of spaced apart, parallel elongated elastic cords are stitched into the gathered material and extending generally perpendicular to the axis of the folds of the gathers, the elastic cords being stretchable in the direction of their longitudinal axis, and the elastic elongated cords being in a relaxed condition prior to installation of the cover on the mattress.

The present invention also provides a method of making a fitted mattress covering comprising the steps of forming a top panel to overlay the top side of a mattress, forming a peripheral depending skirt to overlay the sides and ends of the mattress by forming a flat layer of fabric material, concurrently stitching a plurality of strained spaced-apart, parallel elastic cords progressively along the length of the cords to the flat layer of skirt fabric material, progressively attaching the layer of fabric material skirt to the peripheral edge of the top panel while maintaining the strain on the elastic cords, and allowing the elastic cords to progressively relax as the layer of skirt fabric material is progressively attached to the periphery of the top panel thereby progressively gathering the fabric material and producing a gathered depending mattress cover skirt.

The present invention further provides a method of making a fitted mattress covering comprising the steps of forming a fabric pattern having a top panel to overlay the top side of a mattress, two opposite side panels unitary with the top panel and coextensive in length with the length of the top panel for overlaying the two opposite sides of the mattress, and two opposite end panels unitary with the top panel and coextensive in length with the width of the top panel for overlaying the two opposite ends of the mattress, folding the side panels about an imaginary line at the juncture of the side panels and top panel, folding the end panels about an imaginary line at the juncture of the end panels and top panel, attaching the adjacent end edges of the end panels and side panels to form a peripheral depending mattress cover skirt with four mattress corner receiving corners, each corner for receiving a different one of the corners of the mattress, and concurrently stitching a plurality of strained spaced-apart, parallel elastic cords progressively into the depending skirt along the length dimension of the side panels and along the length dimension of the end panels while maintaining the strain on the elastic cords, and allowing the elastic cords to progressively relax as they are stitched into the fabric skirt material thereby progressively gathering the fabric skirt material and producing a gathered depending mattress cover skirt.

BRIEF DESCRIPTION OF THE DRAWINGS

A better understanding of the invention will be had upon reference to the following discussion in conjunction with the accompanying drawings, wherein like numerals refer to like parts throughout the several views and in which.

DETAILED DESCRIPTION OF THE PREFERRED EMBODIMENT

Figure 1:
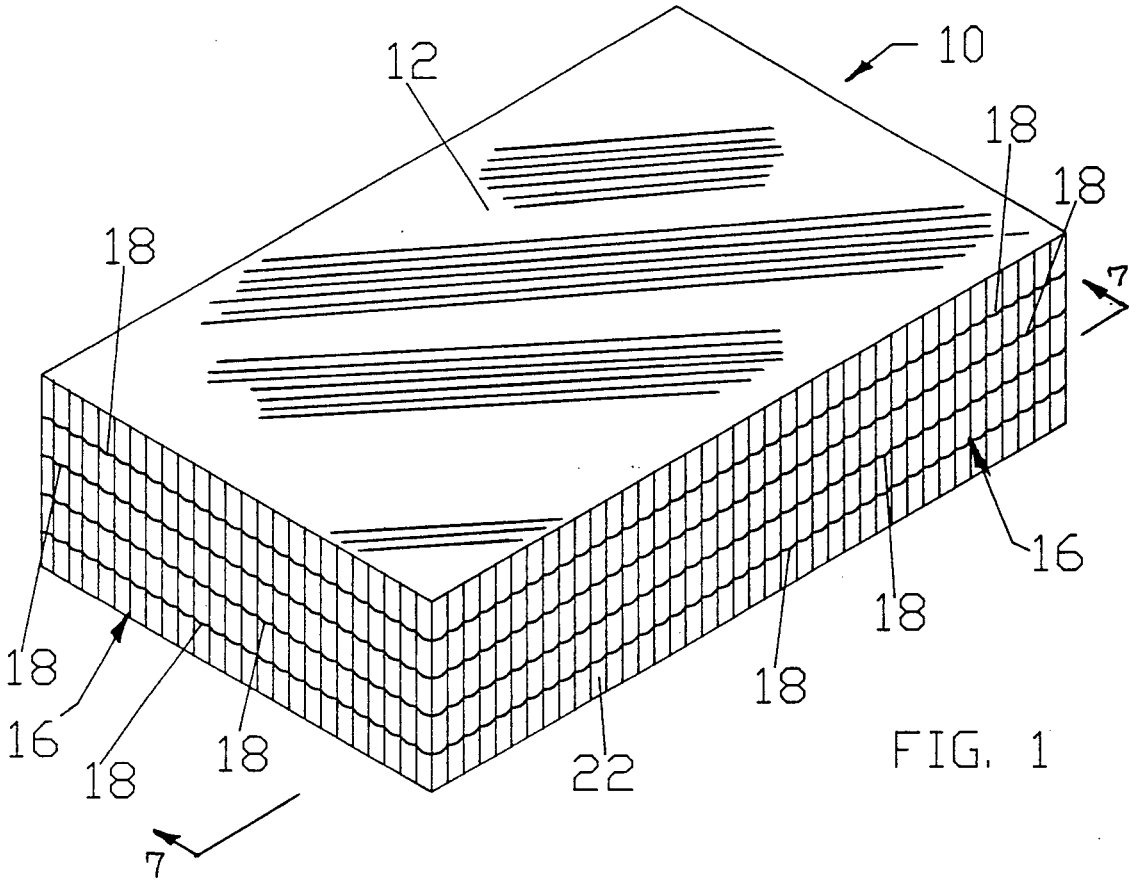
FIG. 1 is a perspective top view of one embodiment of a mattress cover of the present invention.
Figure 2:
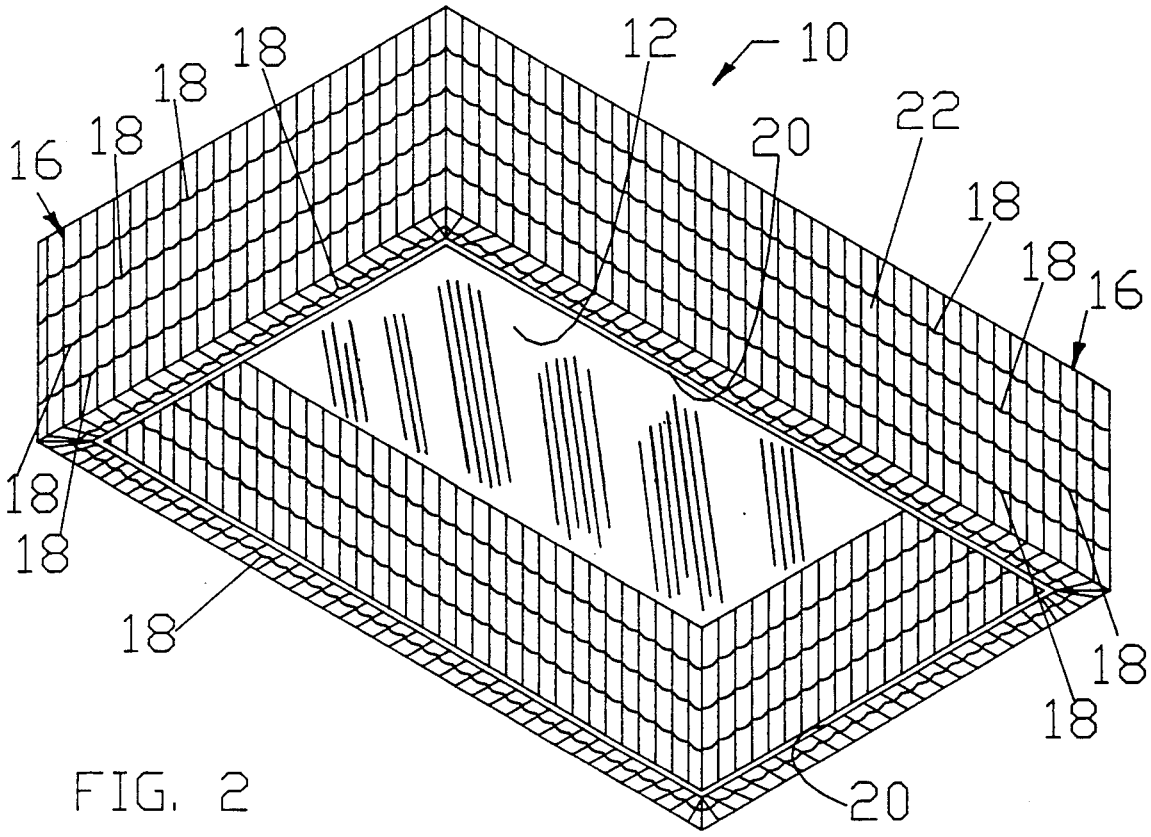
FIG. 2 is a perspective bottom view of the mattress cover of FIG. 1.
Figure 3:
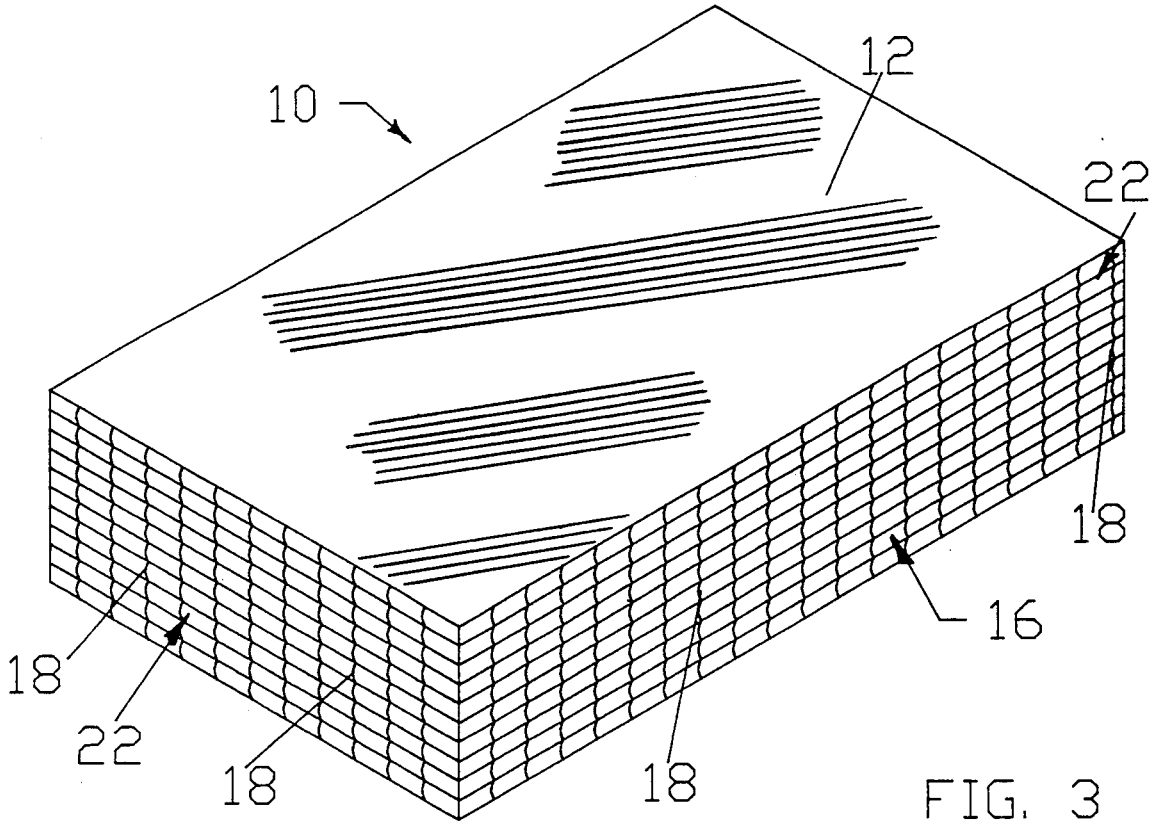
FIG. 3 is a perspective top view of another embodiment of a mattress cover of the present invention.
Figure 4:
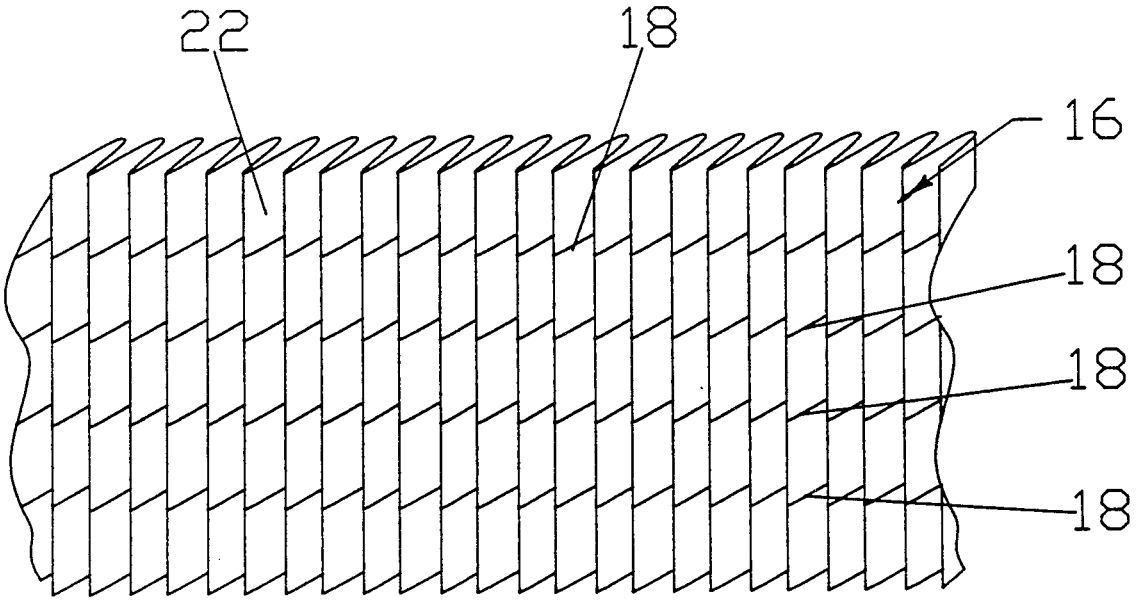
FIG. 4 is an enlarged view of a section of a component of the mattress cover of FIGS. 1 and 3.

With reference to FIGS. 1, 2 and 3, there is shown a fitted mattress cover, generally denoted as the numeral 10, of the present invention. The fitted mattress cover 10 includes a top panel 12 of generally rectangular peripheral shape for fitting in overlaying relationship to the top surface of a mattress 14 and a depending peripheral skirt 16 at the peripheral edge of the top panel and depending therefrom for fitting in overlaying relationship to the sides and ends of the mattress.

With continued reference to FIGS. 1, 2, and 3, the depending skirt 16 comprises a gathered single layer of substantially inelastic fabric material 22 with a plurality of spaced-apart parallel, elongated cords 18, such as elastic strips or yarn, stitched into the inelastic skirt material 22 extending generally perpendicular to the longitudinal axis of the folds of the gathers with the elastic cords being in a relaxed condition prior to the installation of the cover 10 on the mattress 12. It should be clearly understood that the layer of fabric material 22 can be formed of a plurality of fabric plies.

It should be clearly understood at this point that FIGS. 1–11 show four rows of elastic cords 18 for the sake of simplicity and clarity, but that virtually any number of rows of elastic cords 18 can be incorporated in the skirt 16.

With continued reference to FIGS. 1 and 2, in one embodiment the top edge of the peripheral skirt 16 is attached to the peripheral edge of the top panel 12 by, for example sewing or stitching it thereto in depending relationship with the longitudinal axis of the folds of the gathered skirt material 22 generally perpendicular to the longitudinal dimension of the skirt, that is perpendicular to the juncture of the top panel 12 and skirt 16. Therefore, the longitudinal axis of the folds of the gathers of the skirt 16 are perpendicular to the longitudinal dimension of the sides and ends of the mattress when the cover 10 is installed on the mattress 14 so that the elastic cords 16 tightly radially grip the perimeter of the mattress 14 to firmly hold the cover 10 from shifting on the mattress 14.

With reference to FIG. 3, in another embodiment, the top edge of the peripheral skirt 16 is attached to the peripheral edge of the top panel 12 by, for example, sewing or stitching it thereto in depending relationship with the longitudinal axis of the folds of the gathered skirt material 22 generally parallel to the longitudinal dimension of the skirt, that is parallel to the juncture of the top panel 12 and the skirt 16. Therefore, the longitudinal axis of the folds of the gathers of the skirt 16 are parallel to the longitudinal dimension of the sides and ends of the mattress when the cover 10 is installed on the mattress 14.

With reference to FIGS. 1–4, the elastic cords 18 are stitched into the inelastic fabric material of the skirt 16. This can be done with, for example, a sewing machine, a stitch bonding machine, or the like.

As can be best seen in FIG. 2, an elastic strip 20 is attached to the distal or bottom peripheral edge of the skirt 16 so that, when the cover 10 is installed on the mattress 14, the elastic strip 20 radial contracts pulling the bottom peripheral skirt edge underneath the mattress over the under surface of the mattress 14. The elastic strip 20 can be attached to the skirt 16 in virtually any conventional or otherwise convenient means. For example, the bottom edge of the skirt can be folded over itself forming a hem perpendicular to the longitudinal axis of the folds of the gathers, and the elastic strip 20 can be inserted inside the hem and sewn in place, or the elastic strip can be attached with conventional serging sewing machine directly to the bottom edge of the skirt, thereby eliminating the need to form a folded over hem.

The skirt 16 is constructed of a flat single layer, consisting of one or more plies, of the substantially inelastic skirt material 22 by concurrently stitching the plurality of cords 18 into the flat layer of skirt material 22 while maintaining the cords 18 under longitudinal strain or stretch. The layer of skirt material 22 with the strained elastic cords 18 stitched therein is maintained in a tensioned condition along the longitudinal axis of the cords 18 to prevent the elastic cord 18 from relaxing, and, therefore, preventing the gathers from being formed in the skirt material 22 prior to attaching the skirt material 22 to the top panel 12 to form the skirt 16.

Figure 5:
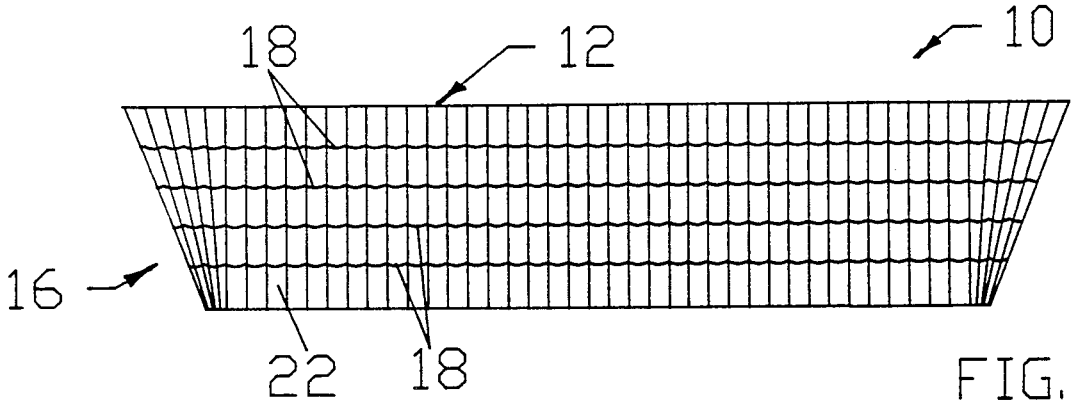
FIG. 5 is a side view of the mattress covering of FIGS. 1 and 2.
Figure 6:
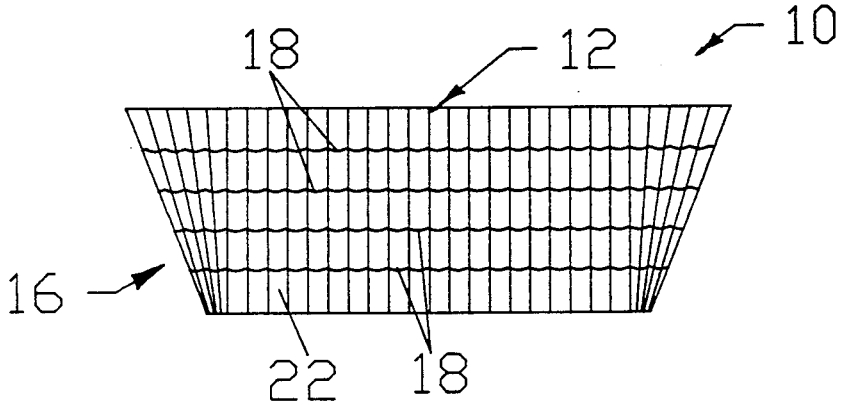
FIG. 6 is an end view of the mattress covering of FIGS. 1 and 2.
Figure 7:
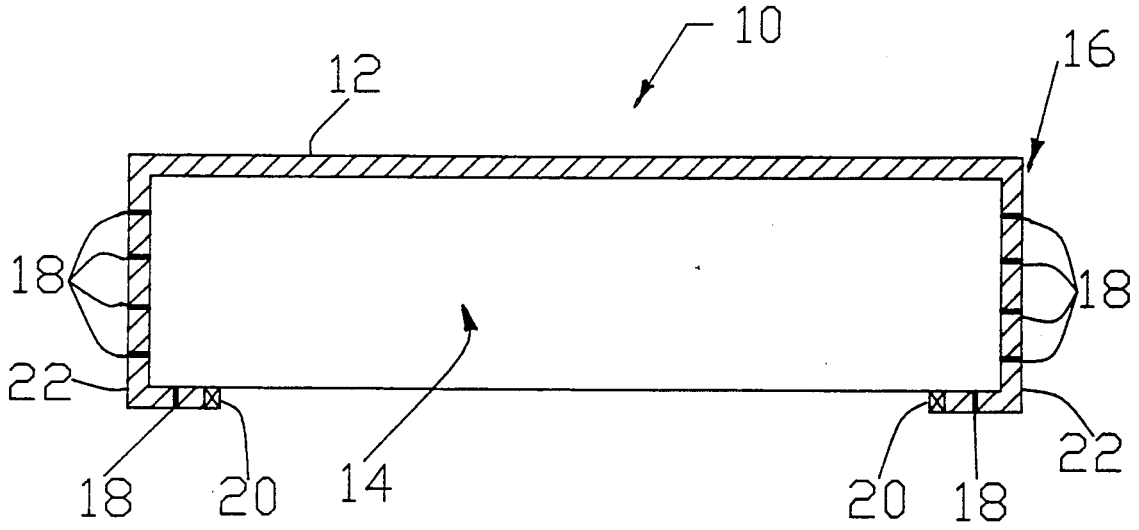
FIG. 7 is a cross-sectional side view of the mattress covering of FIGS. 1 and 2 installed on a mattress.
Figure 9:
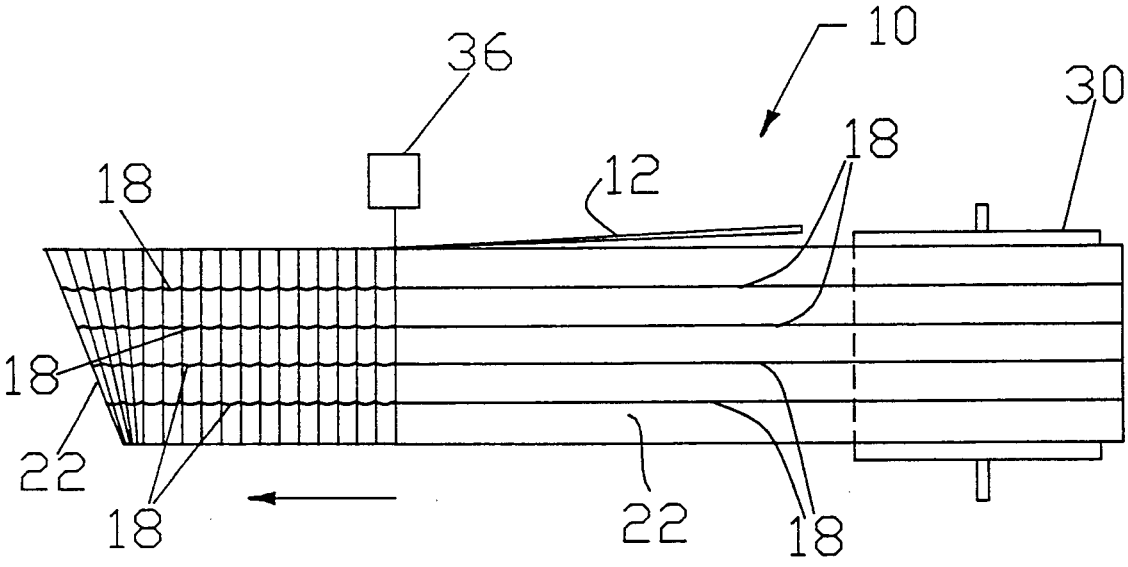
FIG. 9 is a schematic representation of another step of a method of making the mattress cover of FIGS. 1 and 2.

Now with reference to FIG. 9, the inelastic skirt material 22 and, therefore, the elastic cords 18 stitched therein, are maintained under stress or tension in the longitudinal direction of the elastic cords 18 as the top edge of the skirt material 22 is attached to the peripheral edge of the cover top panel 12 to form the depending peripheral skirt 16. This can be accomplished by progressively sewing the skirt material 22 to the peripheral edge of the cover top panel 16. As the skirt material 22 is progressively attached to the peripheral edge of the cover top panel 12, the stress or tension is relieved allowing the elastic cords 18 to longitudinally contract to the relaxed condition forming the gathers in the skirt material 22. With reference to FIG. 5 and 6, when the skirt material 22 has been attached to the peripheral edge of the cover top panel 12 forming the skirt 16, the skirt 16 tapers toward its bottom peripheral edge or hem.

Figure 8:
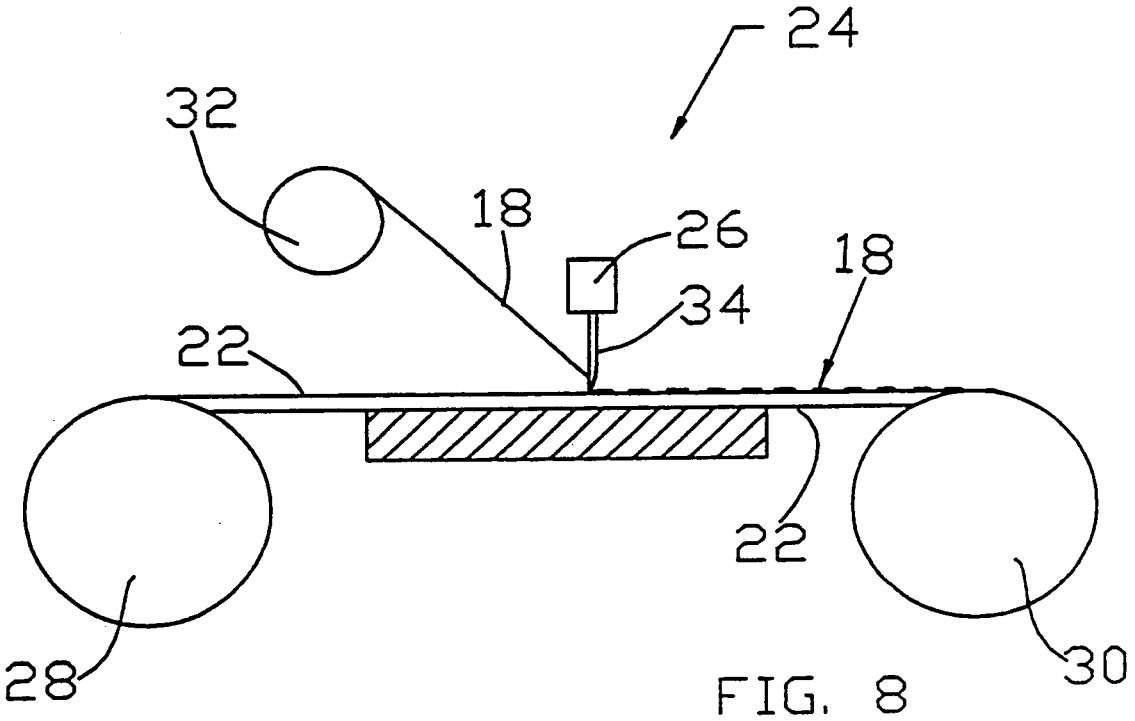
FIG. 8 is a schematic representation of a step of a method of making the component of FIG. 4.

As previously mentioned, the elastic cords 18 can be stitched into the skirt fabric 22 using, for example, a multi-needle device such as a multi-head sewing machine, stitch bonding machine, or quilting machine. FIG. 8 illustrates, in schematic side view, a multi-needle device 24 having a plurality of sewing or stitching heads 26 used to stitch the elastic cords 18 into the inelastic skirt material 22. Because FIG. 8 is a side view, only one needle device 24 is visible, it being understood that the plurality needle-devices 24 are spaced apart in a row transversely across the width of the skirt material 22. As shown, the inelastic skirt material 22 is wound on a supply roll 28 located at the feed end of the multi-needle device 24 which supplies the length of skirt material 22 to the stitching heads 26, and a take-up roll 30 at the discharge end of the multi-needle device 24 to receive the skirt material 22 with the parallel rows of elastic cord 18 stitched therein. The supply roll 28 and take-up roll 30 cooperate to maintain the skirt material 22 under tension throughout the process. The elastic cord 18 is wound on supply spools 32 supplying elastic cords 18 under tension in a strained condition to each of the needles 34 of the sewing or stitching heads 26. The needles 34 progressively stitch the strained or tensioned elastic cord 18 into the flat single layer of skirt material 22 as the skirt material 22 passes therebeneath. The tension on the skirt material 22 created by the supply roll 28 and the take-up roll 30 prevents the stretched elastic cord stitches from relaxing and, thereby, prevents the gathers from forming in the skirt material until after the skirt material 22 is attached to the cover top panel 12 as discussed above.

Now with reference once again to FIG. 9, the skirt material 22 is sewn to the peripheral edge of the top panel 12 by, for example, a sewing head 36. The take-up roll 30 of skirt material 22 having the elastic cords 18 stitched therein is positioned near the sewing head 36 to gradually feed the skirt material 22 to the sewing head 36 while maintaining the stress thereon preventing the elastic cords 18 from relaxing and thereby preventing the gathers from being formed in the skirt material 22. As the skirt material 22 is sewn to the peripheral edge of the cover top panel 12 by the sewing head 36, the stress on the skirt material 22 is relieved allowing the strained elastic cords 18 stitched therein to relax so that they contract forming gathers in the skirt material 22 progressively as the skirt material 22 is being stitched to the cover top panel 12.

Figure 10:
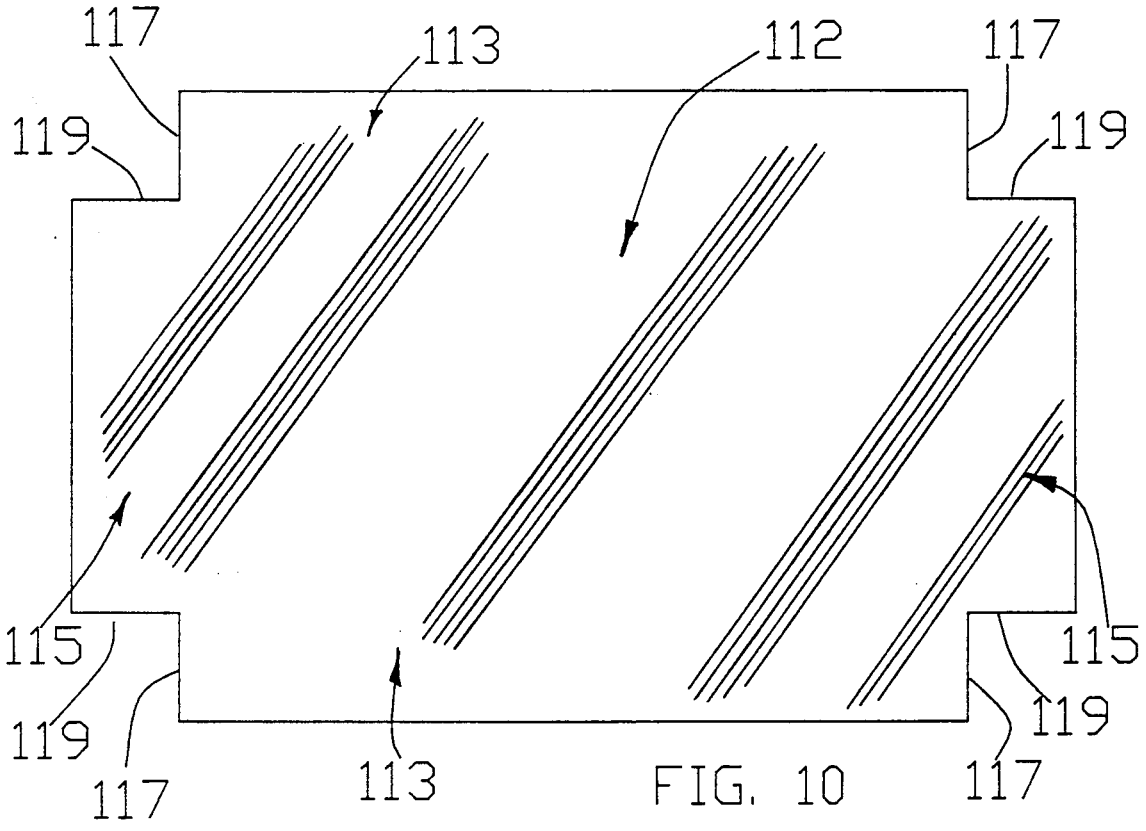
FIG. 10 is a schematic representation of a step of another method of making the mattress cover of FIGS. 1 and 2.
Figure 11:
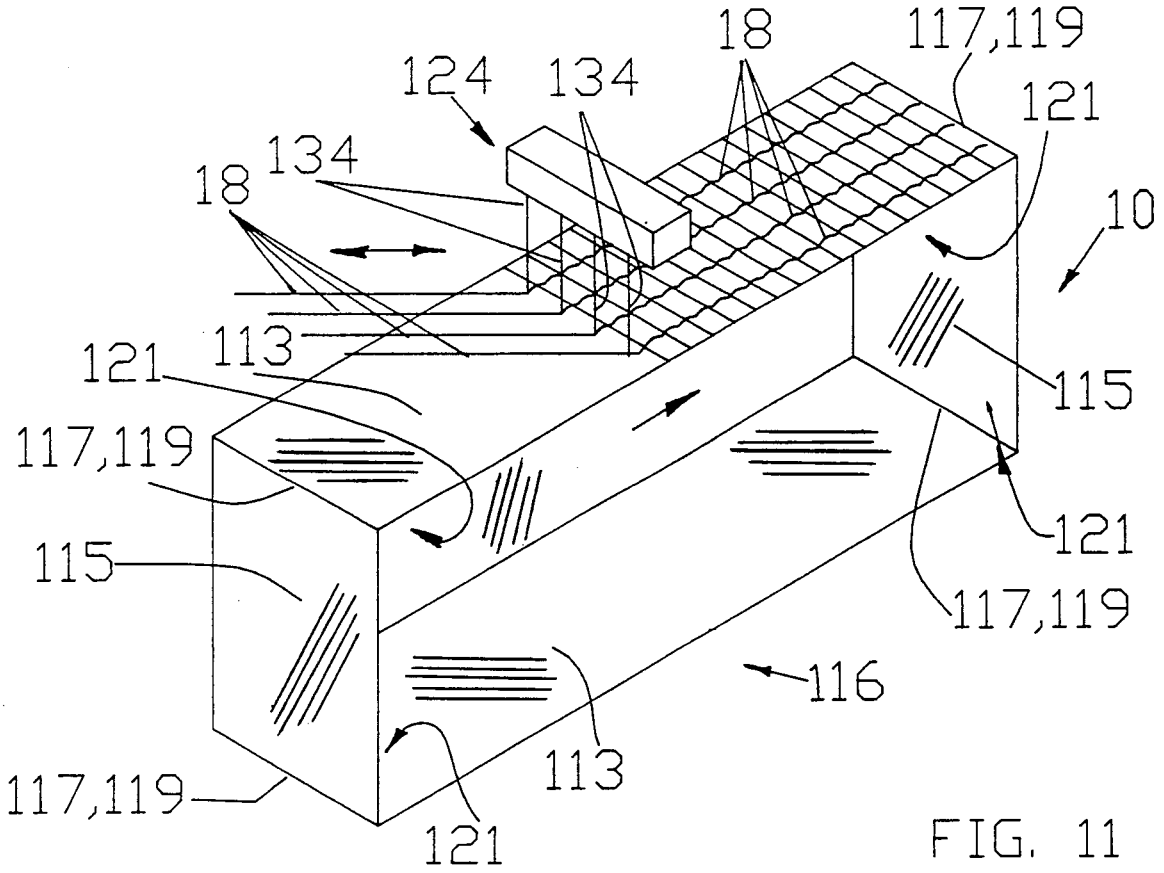
FIG. 11 is a schematic representation of another step of making the mattress cover of FIGS. 1 and 2.

Now with reference to FIGS. 10 and 11, there is schematically illustrated another method for making the fitted mattress cover 10 of FIGS. 1 and 2. Initially, inelastic fabric material is cut or otherwise formed into a pattern having a top panel 112 to overlay the top side of a mattress, two opposite side panels 113 unitary with the top panel 112 and coextensive in length with the length of the top panel 112 for overlaying the two opposite sides of the mattresses, and two opposite end panels 115 unitary with the top panel 112 and coextensive in length with the width of the top panel 112 for overlaying the two opposite ends of the mattress. The side panels 113 are folded downwardly about an imaginary line at the juncture of the side panels 113 and top panel 112, and the end panels 115 are folded downwardly about an imaginary line at the juncture of the end panels 115 and top panel 112. The end edges 117 of the side panels 113 are attached to the adjacent end edges 119 of the end panels 115 to form a peripheral depending skirt 116 with four corners 121, each corner 121 for receiving a different one of the corners of the mattress. Next, a plurality of strained, spaced apart, parallel elastic cords 18 are progressively stitched into the fabric of the peripheral depending skirt 116 along the length dimension of the side panels 113 and along the length dimension of the end panels 115 while maintaining the strain on the elastic cords 18. As the elastic cords 18 are stitched into the depending skirt 116, they are allowed to relax thereby progressively forming gathers in the skirt 116 producing a gathered depending mattress cover skirt. This can be accomplished by using, for example, a multi-needle device 124 such as a multi-head sewing machine, stitch bonding machine, or the like. FIG. 11 illustrates a multi-needle device 124 having a plurality of sewing or stitching needles 134 used to stitch the elastic cords 18 into the inelastic material of the side panels 113 and end panels 115 after they are folded and attached together at their adjacent end edges 117, 119 to form the skirt 116. The needles 134 are spaced apart from each other transversely of the mattress cover side panels 113 and end panels 115 such that the total distance between the end most ones of the plurality of needles 134 is less than the width dimension of the mattress cover side panels 113 and end panels 115. The elastic cord 18 is supplied under tension in a strained condition to each of the needles 134 of the sewing heads 126 from appropriately located spools of elastic cord. The needles 134 progressively stitch the strained or tensioned cords 18 into the flat layer material of the skirt side panels 113 and end panels 115 as the panels 113 and 115 pass beneath the needles 134. As the elastic cords 18 are stitched to the side panels 113 and end panels 115 of the skirt 116, the stress is relieved allowing the elastic cords 18 to longitudinally contract to the relaxed condition progressively forming the gathers in the skirt 116.

The above-discussed invention advantageously further provides an extensibility of the skirt 16, 116 in the longitudinal direction of the elastic cords 18 of from 75% to 100%.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

I claim:

1. A method of making a fitted mattress cover having a top panel for fitting in overlaying relationship to a top surface of a mattress and a peripheral skirt for overlaying the sides and ends of the mattress, comprising the steps of:

concurrently progressively stitching a plurality of longitudinally stressed, parallel, spaced-apart rows of elastic cords into the peripheral skirt generally parallel to a juncture of the peripheral skirt and top panel; and, allowing the elastic cords to progressively relax as the cords are stitched into the skirt thereby progressively forming gathers in the skirt.

2. A method of making a fitted mattress cover having a top panel for fitting in overlaying relationship to a top surface of a mattress and a peripheral depending skirt for fitting in overlaying relationship to the sides and ends of the mattress comprising the steps of:

forming a flat layer of relatively inelastic fabric skirt material;

longitudinally tensioning the inelastic fabric skirt material;

stitching a plurality of longitudinally stressed parallel, spaced-apart rows of elastic cords into the tensioned flat layer of inelastic material in the direction of the tension force on the inelastic skirt fabric material while maintaining the tension on the inelastic fabric material;

attaching the inelastic fabric to the peripheral edge of the mattress cover top panel thereby forming the depending peripheral mattress cover skirt while maintaining the tension on the inelastic skirt fabric material having the rows of elastic cords stretched therein to prevent the elastic cords from relaxing; and, allowing the rows of elastic cords to relax after the inelastic skirt fabric material is attached to the peripheral edge of the mattress cover top panel, thereby forming gathers in the inelastic fabric skirt material.

3. The method of claim 2, wherein the step of attaching the inelastic fabric skirt material to the mattress cover top panel further comprises orienting the inelastic fabric skirt material having the rows of elastic cords stitched therein relative to the mattress cover top panel with the rows of elastic cords generally parallel to the peripheral edge of the mattress cover top panel.

4. The method of claim 3, wherein the step of allowing the elastic cords to relax comprises releasing the tension on the inelastic skirt material attached to the mattress cover panel.

5. A method of making a fitted mattress cover having a top panel for fitting in overlaying relationship to a top surface of a mattress and a peripheral depending skirt for fitting in overlaying relationship to the sides and ends of the mattress comprising the steps of:

forming a flat layer of relatively inelastic fabric skirt material to be attached to the top panel of the cover;

longitudinally tensioning the inelastic fabric skirt material;

stitching a plurality of longitudinally stressed, parallel, spaced-apart rows of elastic cords into the tensioned flat layer of inelastic material in the direction of the tension forces on the inelastic skirt fabric while maintaining the tension on the inelastic fabric material;

progressively attaching the inelastic fabric skirt material to the peripheral edge of the mattress cover top panel while maintaining the tension on the inelastic skirt material to prevent the elastic cords stitched therein from relaxing; and, allowing the elastic cords in a portion of the fabric skirt material being attached to the cover top panel to relax as the inelastic fabric skirt material is progressively attached to the cover top panel, thereby progressively forming gathers in the inelastic fabric skirt material as it is being attached to the cover top panel.

6. The method of claim 5, wherein the step of attaching the inelastic fabric skirt material to the mattress cover top panel further comprises orienting the inelastic fabric skirt material having the rows of elastic cords stitched therein relative to the mattress cover top panel with the rows of elastic cords generally parallel to the peripheral edge of the mattress cover top panel.

7. The method of claim 5, wherein the step of allowing the elastic cords to progressively relax comprises progressively releasing the tension on the inelastic skirt material as it is progressively attached to the mattress cover panel.

8. A method of making a fitted mattress cover having a top panel for fitting in overlaying relationship to a top surface of a mattress and a peripheral skirt for overlaying the sides and ends of the mattress, comprising the steps of:

forming a fabric pattern having a top panel, two opposite side panels unitary with the top panel and coextensive in length with the top panel, and two opposite end panels unitary with the top panel and coextensive in length with the width of the top;

folding the side panels downwardly about an imaginary line at a juncture of the side panels and the top panel;

folding the end panels downwardly about an imaginary line at a juncture of the end panels and the top panel;

attaching adjacent end edges of the end panels and side panels together to form a peripheral depending mattress cover skirt; and concurrently progressively stitching a plurality of longitudinally stressed, parallel, spaced apart rows of elastic cords into the skirt; and, allowing the elastic cords to progressively relax as the elastic cords are stitched into the skirt, thereby progressively forming gathers in the skirt.

9. The method of claim 8, wherein the step of stitching the elastic cords to the skirt comprises stitching the elastic cords along the length dimension of the side panels and end panels of the skirt.

10. A method of making a fitted mattress cover comprising the steps of:

forming a cover top panel for fitting in overlaying relationship to a top surface of a mattress;

tensioning a layer of fabric material having a plurality of elastic cords stitched therein to stress the elastic cords in the longitudinal direction of the elastic cords;

progressively attaching the layer of fabric material to the peripheral edge of the mattress cover top panel with the longitudinal axis of the elastic cords oriented generally parallel to the peripheral edge of the mattress top cover while maintaining the tension on the fabric material to prevent the elastic cords thereon from relaxing; and, allowing the elastic cords in a portion of the fabric material being attached to the cover top panel to relax as the fabric layer is progressively attached to the cover top panel, thereby progressively forming gathers in the fabric layer as it is being attached to the cover panel.

* * * * *